US012419368B2

(12) United States Patent
Park

(10) Patent No.: US 12,419,368 B2
(45) Date of Patent: Sep. 23, 2025

(54) METHOD OF MANUFACTURING MASK HAVING DIFFERENT INNER AND OUTER SURFACE STRUCTURES AND MASK MANUFACTURED BY SAME METHOD

(71) Applicant: Min Gyu Park, Incheon (KR)

(72) Inventor: Min Gyu Park, Incheon (KR)

( * ) Notice: Subject to any disclaimer, the term of this patent is extended or adjusted under 35 U.S.C. 154(b) by 431 days.

(21) Appl. No.: 18/155,808

(22) Filed: Jan. 18, 2023

(65) Prior Publication Data

US 2023/0225431 A1 Jul. 20, 2023

(30) Foreign Application Priority Data

Jan. 20, 2022 (KR) ..... 10-2022-0008258

(51) Int. Cl.
*A41D 13/11* (2006.01)
*A41H 43/00* (2006.01)

(52) U.S. Cl.
CPC ..... *A41D 13/1115* (2013.01); *A41H 43/00* (2013.01)

(58) Field of Classification Search
CPC ... A41D 13/11–1192; A62B 7/00; A62B 7/10; A62B 18/00; A62B 18/02; A62B 18/025; A62B 23/00; A62B 23/02; A41H 43/00; A41H 43/02; A41H 43/025; A41H 43/0257
See application file for complete search history.

(56) References Cited

U.S. PATENT DOCUMENTS 3,971,369 A * 7/1976 Aspelin ..... A41D 13/1115 128/206.19
6,070,578 A * 6/2000 Baughman ..... A41D 13/1192 128/205.27

* cited by examiner

*Primary Examiner* — Michelle J Lee
(74) *Attorney, Agent, or Firm* — KORUS Patent, LLC; Seong Il Jeong

(57) ABSTRACT

Proposed is a method of manufacturing a mask and the mask. In the mask, an inner surface sheet and an outer surface sheet have colors different from each other, and a user is capable of wearing the mask by exposing the inner surface sheet to the outside or by exposing the outer surface sheet to the outside. In addition, since a diamond-shaped portion and a linear-shaped portion are provided on the mask, the appearance of the mask is different from a mask of other people. Furthermore, since an upper covering portion and a lower covering portion which extend from the outer surface sheet and which respectively covers an upper portion and a lower portion of the inner surface sheet are provided in band shapes, aesthetic sense may further be improved when the user wears the mask by exposing the inner surface sheet to the outside.

3 Claims, 12 Drawing Sheets

METHOD OF MANUFACTURING MASK HAVING DIFFERENT INNER AND OUTER SURFACE STRUCTURES AND MASK MANUFACTURED BY SAME METHOD

CROSS REFERENCE TO RELATED APPLICATION

The present application claims priority to Korean Patent Application No. 10-2022-0008258, filed Jan. 20, 2022, the entire contents of which are incorporated herein for all purposes by this reference.

BACKGROUND OF THE INVENTION

Field of the Invention

The present disclosure relates to a method of manufacturing a mask having different inner and outer surface structures and the mask manufactured by the same method. More particularly, the present disclosure relates to a method of manufacturing a mask having different inner and outer surface structures and the mask, the mask being configured such that the inner surface and the outer surface have structures and colors different from each other so that the same structure and the same color of masks of others making a user feel bored is prevented by wearing the mask of the present disclosure, and the mask being configured to improve a fashion sense so that clothes that the user wears are well-matched with the mask.

Description of the Related Art

Generally, a mask is configured to block the inhalation of fine dust and so on during activities while covering respiratory organs such as the nose and the mouth and is configured to block fine dust in air from being inhaled through the nose and to block substances scattered from the mouth.

As the coronavirus-19 is rapidly spreading not only in Korea but also around the world, such a mask has become a daily necessity that people in Korea and people around the word are required to wear every day.

That is, the coronavirus is a pandemic disease which infects through respiratory organs and which shows a highly contagious characteristic at the beginning of infection with few symptoms. After infection, the coronavirus develops into pneumonia after symptoms such as sore throat, high fever, cough, and difficulty breathing, and leads to death in severe cases. Therefore, it is essential to wear a mask in a daily life in order to prevent not only the spread of the coronavirus but also the infection caused by the corona virus.

Furthermore, the coronavirus is a cause of a respiratory disease in children, elderly people, as well as healthy adults, so that a mask is recognized as a daily necessity to at least prevent respiratory viruses.

In addition, a mask is used throughout industry, and is mainly used to protect the health of a worker at a chemical factory that severely emits toxic gases, a metal smelting site in which metal powder and welding fumes are generated, a paper manufacturing site, a textile factory, and the like. Furthermore, in a semiconductor laboratory in which dust generation is required to be extremely limited, the mask is essential in order to create a clean working space for product quality.

Generally, such a mask includes a mask body formed of a sheet of a fiber material, a sheet-type filter provided inside the mask body, and ear loop strings that enable a user to wear the mask body. Furthermore, the user wears the mask by respectively hanging the ear loop strings on both ears while an inner surface of the mask body is in close contact with the user's face.

However, a conventional mask is distinguished into a pleat-type mask which has a mask body provided with a pleat portion and which can cover a face by being spread while a user wears the pleat-type mask and a bird's beak-type mask having a mask body that has a shape similar to a bird's beak, so that there is a problem that the conventional mask is difficult to be distinguished from masks of other people since the conventional mask is distinguished into two types that are the pleat-type mask and the bird's beak-type mask.

Of course, recently, by differentiating the color of the mask body, a user may select and wear the mask according to the color so that the mask that the user wears is differentiated from masks of other people, but the mask does not significantly reduce the boredom of the appearance of the mask as the shape of the mask body is not significantly differentiated.

As a result, in Korean Patent No. 10-2145265, a functional fashion mask and a manufacturing method thereof have been proposed. The functional fashion mask includes: a first mask sheet including a first face portion that covers a user's mouth and nose and including first ear loop portions which are formed on both sides of the first face portion such that the ear loop portions are formed integrally with the first face portion and which are hung on the user's ears, the first mask sheet being formed of an urethane foam sheet having air permeability, and the first mask sheet forming an inner surface of the mask in contact with the user's face; and a second mask sheet including a second face portion that covers the user's mouth and nose and including second ear loop portions which are formed on both sides of the second face portion such that the ear loop portions are formed integrally with the second face portion and which are hung on the user's ears, the second mask sheet being formed of the urethane foam sheet having air permeability, and the second mask sheet forming an outer surface of the mask by being stacked on an outside of the first mask sheet. Furthermore, the first mask sheet and the second mask sheet are attached to each other by a fusion portion that is formed on a center portion in a horizontal length direction of the first and second face portions.

In the conventional technology as described above, a filter member and a heating sheet is inserted and used, and the conventional technology has a cosmetic effect and the user can fashionably wear the mask of the conventional technology by differentiating a color and a pattern of the mask. However, as the overall appearance of the mask is not significantly differentiated from the conventional bird's beak shape, the problem that the overall aesthetic sense of the mask is reduced and the boredom of the overall appearance of the mask is not reduced has not been solved.

As another example, a mask on which a photograph of an entertainer is copied has been proposed in Korean Patent Application Publication No. 10-2018-0080588. In addition, the mask includes: a body portion positioned on a part of a user's face including a user's nose and mouth; hanging portions which are provided on both sides of the body portion and which are respectively hung on the user's ears such that the body portion is positioned on the user's face; and an image portion printed on a first side of the body portion. Furthermore, a fashion effect may be expected by the image portion that is printed on the first side of the body portion.

However, since a shape of the mask of the conventional technology as described above is not significantly differentiated from a shape of an existing cloth mask, there is a problem that the mask of the conventional technology is not differentiated from masks that other people wear.

Furthermore, in young people called the MZ generation who are very sensitive to latest trends and who seek a unique experience that is different from experiences of others, the young people think that differentiation from others is very important, so that just changing the color to the shape of the existing mask is insufficient to satisfy the desire to purchase the mask.

DOCUMENT OF RELATED ART (Patent Document 1) Korean Patent No. 10-2145265 (registered on Aug. 11, 2020)

(Patent Document 2) Korean Patent Application Publication No. 10-2018-0080588 (published on Jul. 12, 2018)

SUMMARY OF THE INVENTION

Accordingly, the present disclosure has been made keeping in mind the above problems occurring in the related art, and an objective of the present disclosure is to provide a method of manufacturing a mask having different inner and outer surface structures and the mask, the mask being configured such that colors and shapes of inner and outer surfaces of a mask body is different from each other so that a user can select and wears the mask body according to the colors and the shapes, the mask being configured to have a visual differentiation from masks that other people wear so that a consumer's desire of purchasing the mask of the present disclosure is satisfied, and the mask being configured to prevent the boredom of the mask and to improve a fashion sense so that clothes that the user wears are well-matched with the mask.

In order to achieve the above objective, there is provided a method of manufacturing a mask having different inner and outer surface structures, the method including: a mask body manufacturing process in which a nose contact part is positioned at upper portions of an inner surface sheet and an outer surface sheet, the inner surface sheet and the outer surface sheet are overlapped so as to face each other, and high-frequency fusion is performed on borders of the inner surface sheet and the outer surface sheet, thereby manufacturing a mask body; and an ear loop string fusion process in which ear loop strings are high-frequency fused on both sides of the mask body, respectively. In addition, the inner surface sheet and the outer surface sheet may have different colors from each other. Furthermore, in the mask body manufacturing process, center pleat portions, upper pleat portions respectively positioned at upper portions of the center pleat portions, and lower pleat portions respectively positioned at lower portions of the center pleat portions may be respectively provided along a horizontal length direction of the inner surface sheet and a horizontal length direction of the outer surface sheet, and the inner surface sheet and the outer surface sheet may be overlapped such that the center pleat portions, the upper pleat portions, and the lower pleat portions respectively provided at the inner surface sheet and the outer surface sheet are facing each other, and then high-frequency fusion may be performed on the inner surface sheet and the outer surface sheet, thereby manufacturing the mask body. Furthermore, the mask body manufacturing process may include: a pleat portion folding process in which first side ends of the upper pleat portions and first side ends of the lower pleat portions are folded to be positioned adjacent to first side ends of the center pleat portions, respectively, and second side ends of the upper pleat portions and second side ends of the lower pleat portions are folded to be positioned adjacent to second side ends of the center pleat portions, respectively; and a pleat portion fusion process which is performed after the pleat portion folding process and in which the first side ends and the second side ends of the upper pleat portions that are folded and the first side ends and the second side ends of the lower pleat portions that are folded are high-frequency fused and fixed by pleat fusion portions. Furthermore, by the pleat portion folding process and the pleat portion fusion process, a diamond-shaped portion may be provided on the inner surface sheet along the horizontal length direction of the inner surface sheet, and a linear-shaped portion may be provided on the outer surface sheet along the horizontal length direction of the outer surface sheet.

In addition, upper and lower ends of the outer surface sheet may be provided such that the upper and lower ends of the outer surface sheet further extend with respect to upper and lower ends of the inner surface sheet. Furthermore, in the mask body manufacturing process, before the inner surface sheet and the outer surface sheet are overlapped, the upper and lower ends of the outer surface sheet may be respectively folded toward the upper and lower ends of the inner surface sheet and may be high-frequency fused, so that an upper covering portion and a lower covering portion may be respectively provided at the upper end and the lower end of the inner surface sheet. Furthermore, the outer surface sheet may be expressed in a single color, and the inner surface sheet may be expressed in dual colors by the upper covering portion and the lower covering portion.

A mask manufactured by the method includes: a mask body having an upper end provided with a nose contact part; and ear loop strings that are respectively provided at both sides of the mask body, wherein the mask body may include: an inner surface sheet having various colors; an outer surface sheet having a color different from a color of the inner surface sheet; a diamond-shaped portion provided on the inner surface sheet along a horizontal length direction of the mask body; first extension portions respectively provided at an upper portion and a lower portion of the diamond-shaped portion; a linear-shaped portion provided on the outer surface sheet along the horizontal length direction of the mask body; and second extension portions respectively provided at an upper portion and a lower portion of the linear-shaped portion.

In the present disclosure, since the inner surface sheet and the outer surface sheet have colors different from each other, the user may wear the mask by exposing the inner surface sheet or by exposing the outer surface sheet, and dual color expression is capable of being performed by using one mask and the fashion sense may be improved, so that co-ordination expression of the mask is capable of being easily performed since the mask is capable of being naturally well-matched with clothes that the user wears.

In addition, since the diamond-shaped portion is provided on the inner surface sheet and the linear-shaped portion is provided on the outer surface sheet so that the user is capable of wearing the mask by exposing the desired shape portions, the appearance of the mask is capable of being differentiated from the appearance of masks that other people wear, so that boredom of the mask of the present disclosure may be removed and the overall aesthetic sense of the mask of the present disclosure may be elegantly expressed.

In addition, since the diamond-shaped portion and the linear-shaped portion are provided by performing high-frequency fusion after the mask body is folded, a separate transfer printing does not have to be performed on the mask body, so that a respiratory disease caused by a transfer ink may be prevented and the manufacturing cost of the mask may be significantly reduced since the diamond-shaped portion and the linear-shaped portion are provided by a simple operation process.

In addition, since the upper covering portion and the lower covering portion which extend from the outer surface sheet and which respectively cover the upper portion and the lower portion of the inner surface sheet are provided and which are provided in the band shapes, a visual aesthetic sense may be improved by the upper covering portion and the lower covering portion having the band shapes and having the color different from the color of the inner surface sheet when the inner surface sheet is exposed, and the overall appearance of the mask may be elegantly expressed, so that the mask of the present disclosure may be maximally differentiated from masks that other people wear.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE INVENTION

Figure 1:
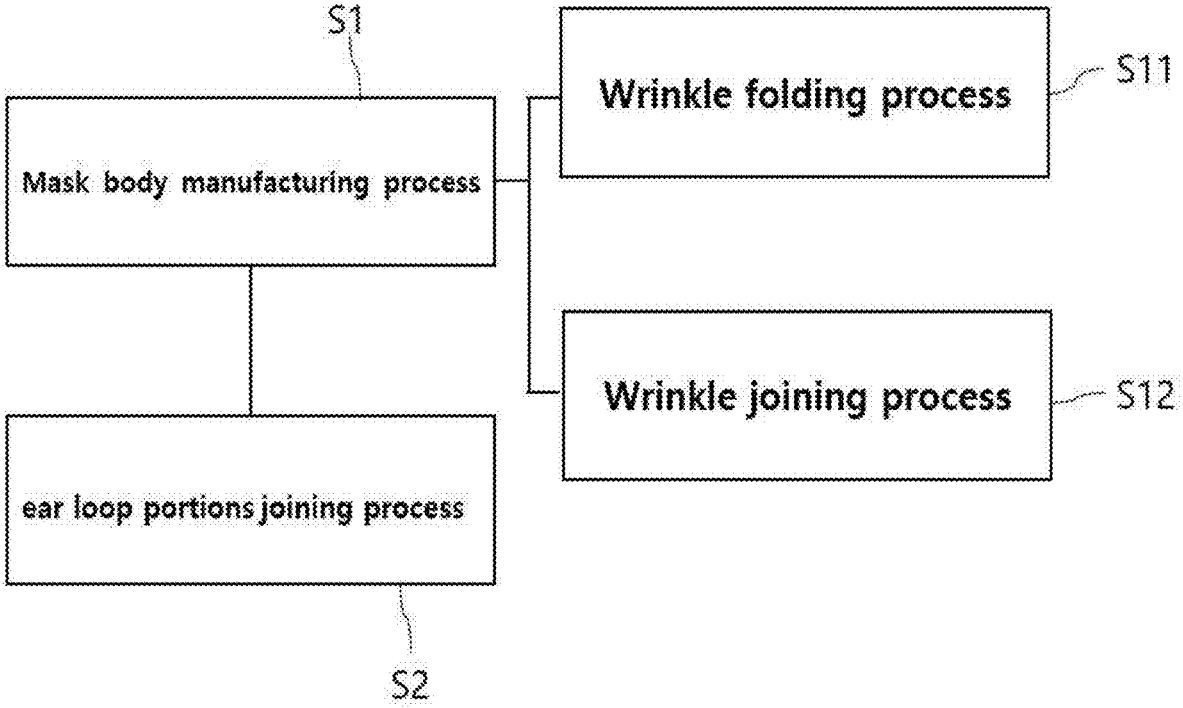
FIG. 1 is a flowchart illustrating a process of a method of manufacturing a mask having different inner and outer surface structures according to the present disclosure.
Figure 2:
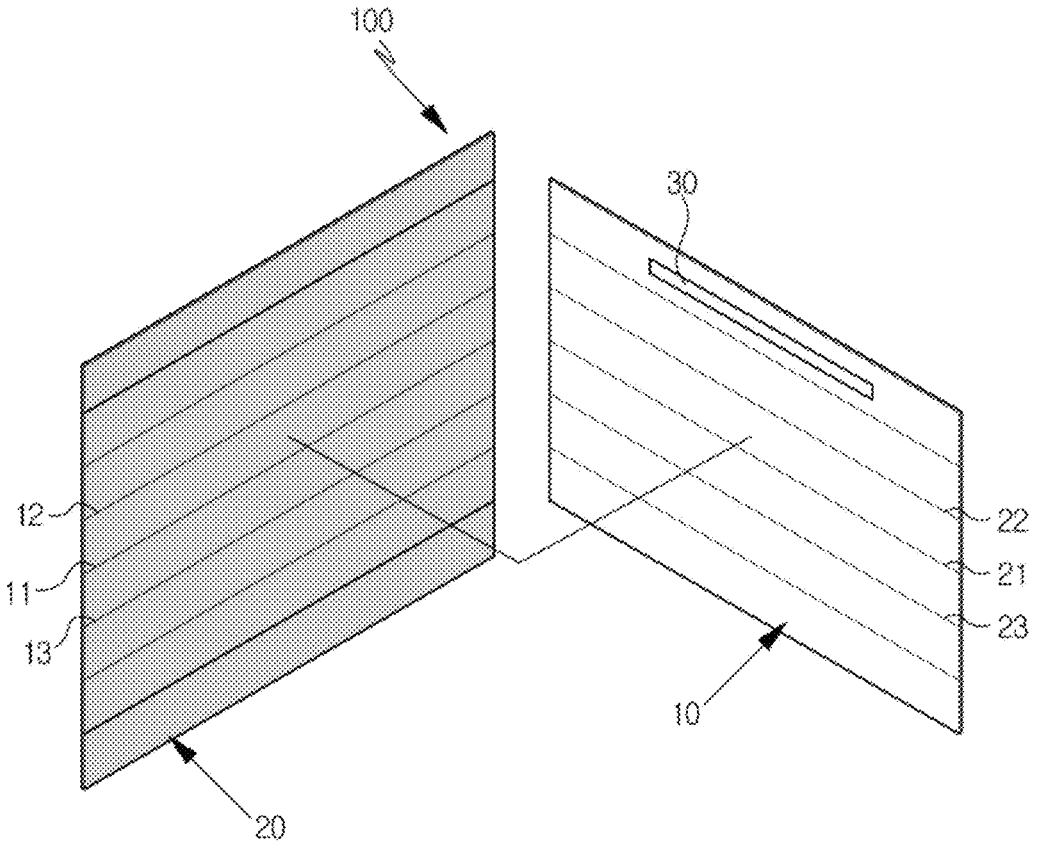
FIG. 2 is an exploded perspective view illustrating a configuration of the mask having different inner and outer surface structures according to the present disclosure.

Hereinafter, other objectives and features of the present disclosure in addition to the above objectives will be apparent from the following description of embodiments with reference to the accompanying drawings.

Unless defined otherwise, all terms used herein including technical or scientific terms have the same meanings as generally understood by a person having ordinary knowledge in the art to which the present disclosure pertains. Terms such as those defined in a commonly used dictionary should be interpreted as having a meaning consistent with the meaning of the related technology, and should not be interpreted as an ideal or excessively formal meaning unless explicitly defined in the present specification.

Hereinafter, a method of manufacturing a mask having different inner and outer surface structures and the mask manufactured by the same method according to an embodiment of the present disclosure will be described in detail with reference to the accompanying drawings. In describing the present disclosure, the mask having different inner and outer surface structures of the present disclosure is manufactured by the method of manufacturing the mask having different inner and outer surface structures of the present disclosure, so that the same term and the same reference numeral are used for the same configuration.

As illustrated in the drawings, the method of manufacturing the mask having different inner and outer surface structures includes: a mask body manufacturing process S1 in which a nose contact part 30 is positioned at upper portions of an inner surface sheet 10 and an outer surface sheet 20, the inner surface sheet 10 and the outer surface sheet 20 are overlapped so as to face each other, and high-frequency fusion is performed on borders of the inner surface sheet 10 and the outer surface sheet 20, thereby manufacturing a mask body 100; and an ear loop string fusion process S2 in which ear loop strings 40 are high-frequency fused on both sides of the mask body 100, respectively.

The inner surface sheet 10 and the outer surface sheet 20 of the present disclosure have different colors from each other.

As such, since the inner surface sheet 10 and the outer surface sheet 20 have different colors from each other, the color of the mask when a user wears the mask while the user exposing the inner surface sheet 10 and the color of the mask when the user wears the mask while the user exposing the outer surface sheet 20 are expressed differently, so that two color effects may be realized by using one mask.

In the mask body manufacturing process S1 of the present disclosure, center pleat portions 11 and 21, upper pleat portions 12 and 22 respectively positioned at upper portions of the center pleat portions 11 and 21, and lower pleat portions 13 and 23 respectively positioned at lower portions of the center pleat portions 11 and 21 are respectively provided along a horizontal length direction of the inner surface sheet 10 and a horizontal length direction of the outer surface sheet 20. Furthermore, the inner surface sheet 10 and the outer surface sheet 20 are overlapped such that the center pleat portions 11 and 21, the upper pleat portions 12 and 22, and the lower pleat portions 13 and 23 respectively provided at the inner surface sheet 10 and the outer surface sheet 20 are facing each other, and high-frequency fusion is performed on the inner surface sheet 10 and the outer surface sheet 20, thereby manufacturing the mask body 100.

As illustrated in the drawings, the center pleat portions 11 and 21, the upper pleat portions 12 and 22, and the lower pleat portions 13 and 23 are provided along a horizontal length direction of the mask body 100. The reason for having the center pleat portions 11 and 21, the upper pleat portions 12 and 22, and the lower pleat portions 13 and 23 as described above is to provide a diamond-shaped portion 60 and a linear-shaped portion 70 on the mask body 100 of the present disclosure.

To this end, the mask body manufacturing process S1 of the present disclosure includes a pleat portion folding process S11 and a pleat portion fusion process S12.

Figure 3:
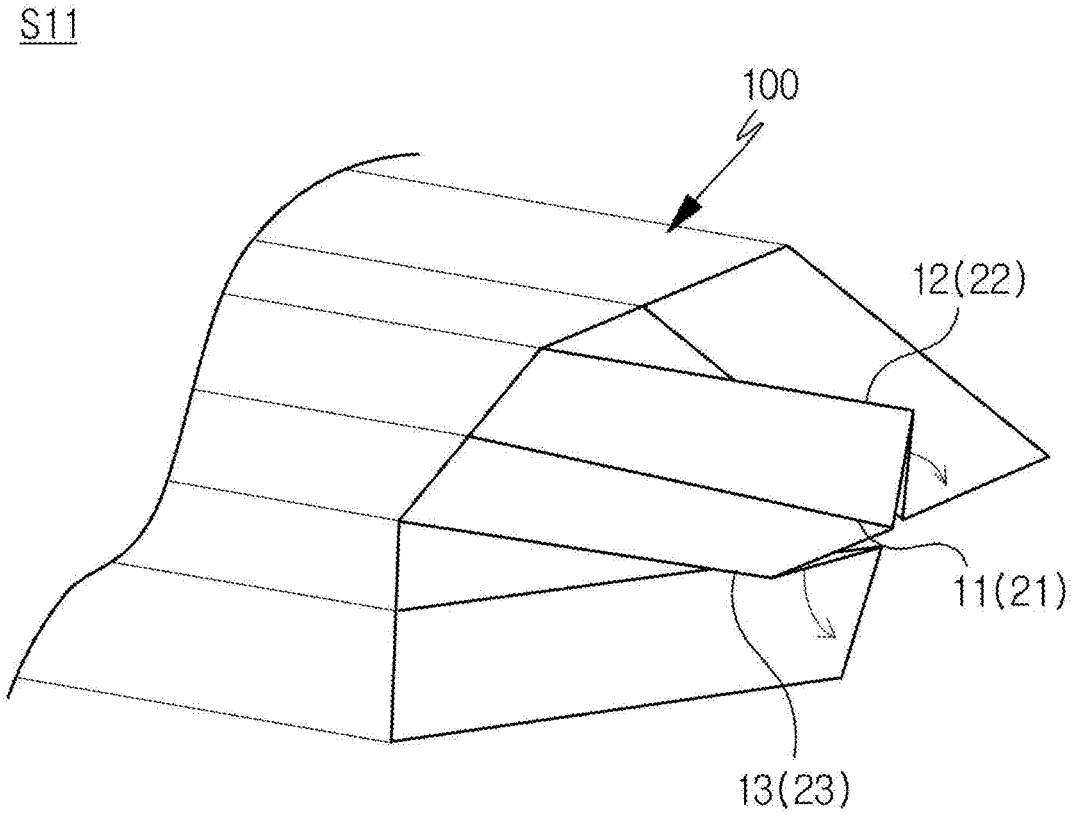
FIGS. 3 and 4 are perspective views illustrating a pleat portion folding process of the method of manufacturing the mask having different inner and outer surface structures according to the present disclosure.
Figure 4:
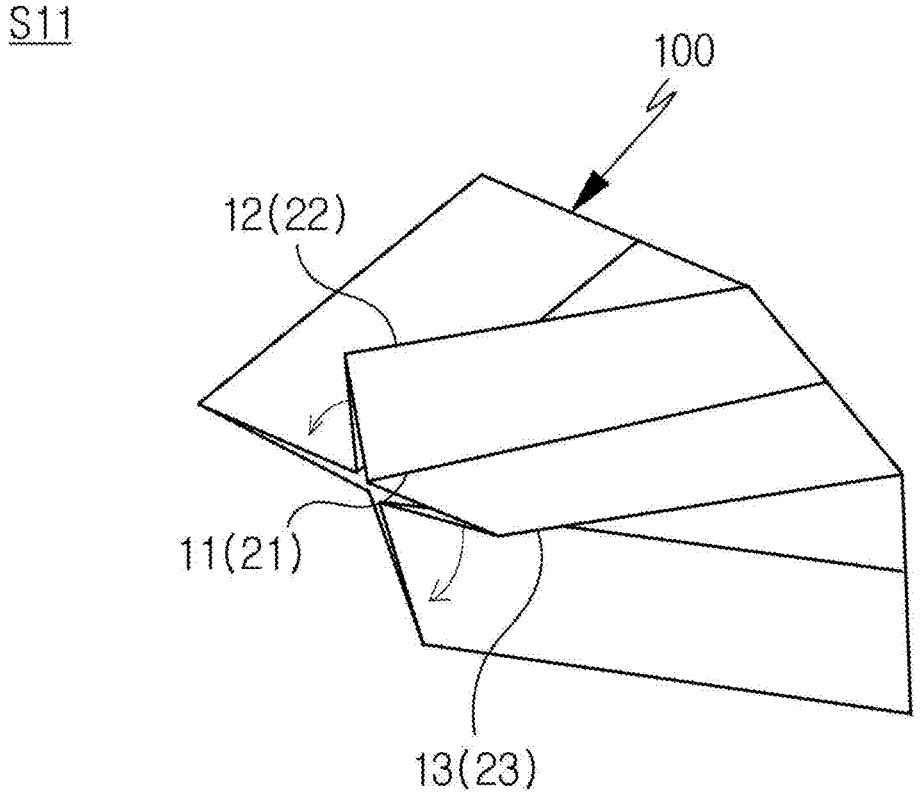

As illustrated in FIGS. 3 and 4, in the pleat portion folding process S11, first side ends of the upper pleat portions 12 and 22 and first side ends of the lower pleat portions 13 and 23 are folded to be positioned adjacent to first side ends of the center pleat portions 11 and 21, respectively, and second side ends of the upper pleat portions 12 and 22 and second side ends of the lower pleat portions 13 and 23 are folded to be positioned adjacent to second side ends of the center pleat portions 11 and 21, respectively.

That is, as illustrated in FIG. 3, first sides of the upper pleat portions 12 and 22 are folded and first sides of the lower pleat portions 13 and 23 are folded, and then the first side ends of the upper pleat portions 12 and 22 that are folded and the first side ends of the lower pleat portions 13 and 23 that are folded are positioned at the first side ends of the center pleat portions 11 and 21.

As such, when the first side ends of both the upper pleat portions 12 and 22 and the lower pleat portions 13 and 23 having the first side folded are positioned adjacent to the first side ends of the center pleat portions 11 and 21, upper and lower portions of a first side of the mask body 100 formed of the inner surface sheet 10 and the outer surface sheet 20 are naturally pulled toward the center pleat portions 11 and 21.

In addition, as illustrated in FIG. 4, second sides of the upper pleat portions 12 and 22 are folded and second sides of the lower pleat portions 13 and 23 are folded, and then the second side ends of the upper pleat portions 12 and 22 and the second side ends of the lower pleat portions 13 and 23 are positioned at the second side ends of the center pleat portions 11 and 21.

As such, when the second side ends of both the upper pleat portions 12 and 22 and the lower pleat portions 13 and 23 having the second side folded are positioned adjacent to the second side ends of the center pleat portions 11 and 21, upper and lower portions of a second side of the mask body 100 formed of the inner surface sheet 10 and the outer surface sheet 20 are naturally pulled toward the center pleat portions 11 and 21.

In the pleat portion fusion process S12 of the present disclosure, the first side ends and the second side ends of the upper pleat portions 12 and 22 that are folded and the first side ends and the second side ends of the lower pleat portions 13 and 23 that are folded are high-frequency fused and fixed by pleat fusion portions 50.

Figure 5:
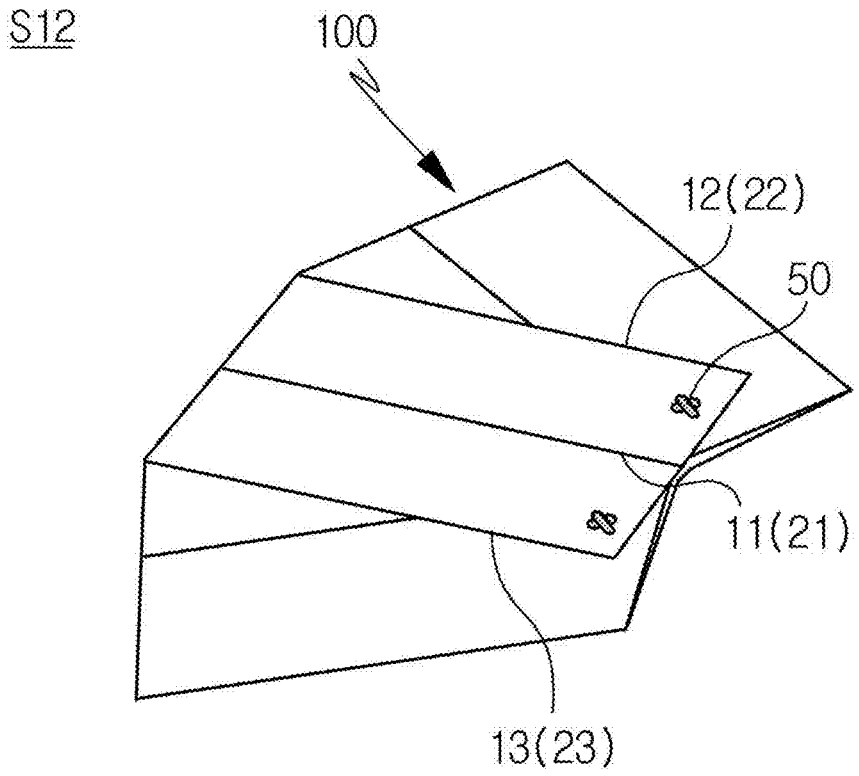
FIGS. 5 and 6 are perspective views illustrating a pleat portion fusion process of the method of manufacturing the mask having different inner and outer surface structures according to the present disclosure.

That is, as illustrated in FIG. 5, the first side ends of the upper pleat portions 12 and 22 that are folded and the first side ends of the lower pleat portions 13 and 23 that are folded are high-frequency fused and fixed to a first side of the outer surface sheet 20 of the mask body 100 that is pulled toward the center pleat portions 11 and 21 by the pleat fusion portions 50.

Figure 6:
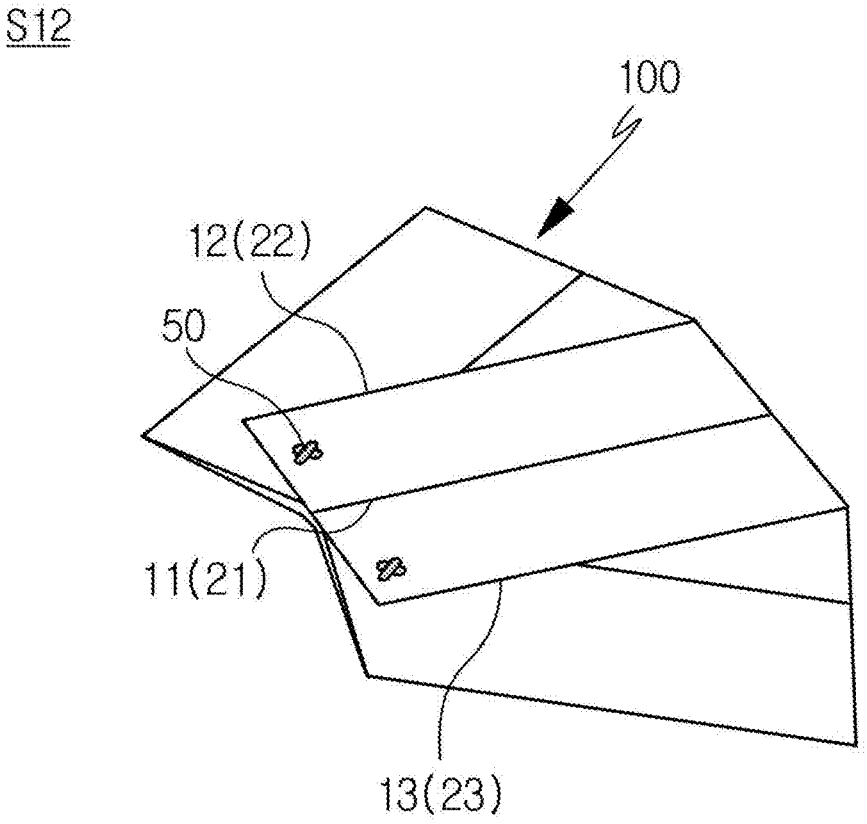

In addition, as illustrated in FIG. 6, the second side ends of the upper pleat portions 12 and 22 that are folded and the second side ends of the lower pleat portions 13 and 23 that are folded are high-frequency fused and fixed to a second side of the outer surface sheet 20 of the mask body 100 that is pulled toward the center pleat portions 11 and 21 by the pleat fusion portions 50.

Figure 7:
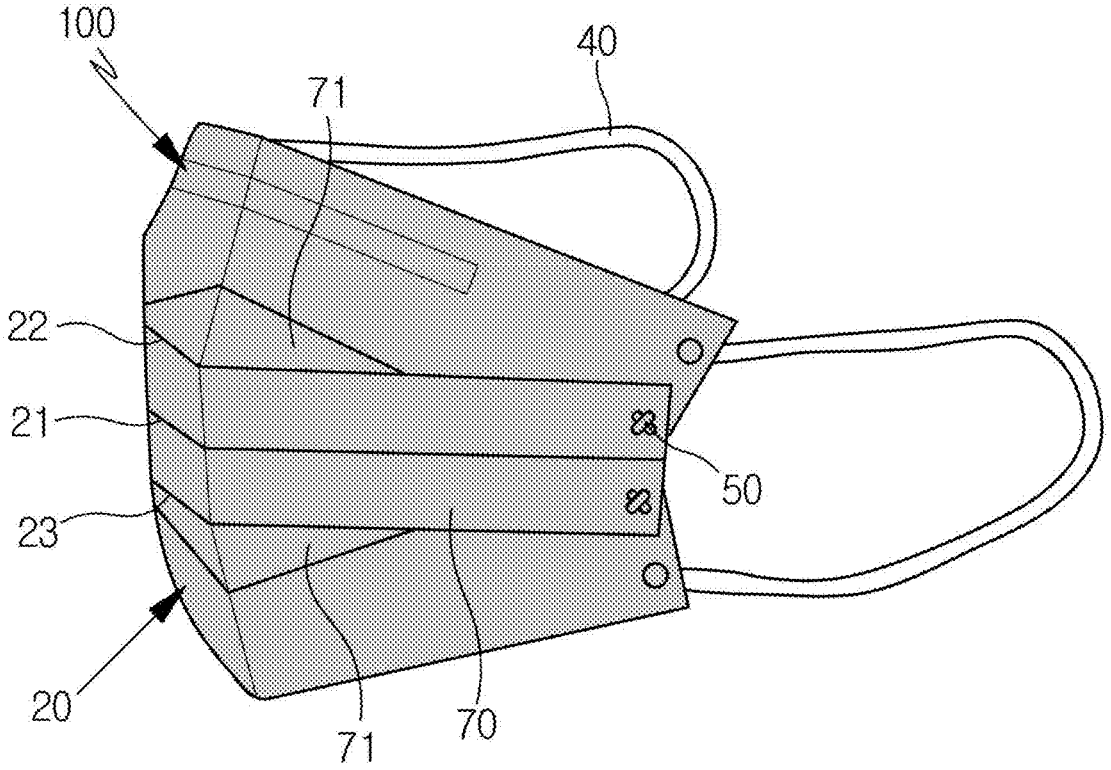
FIG. 7 is a perspective view illustrating a state in which an outer surface sheet of the mask having different inner and outer surface structures according to the present disclosure is exposed.
Figure 8:
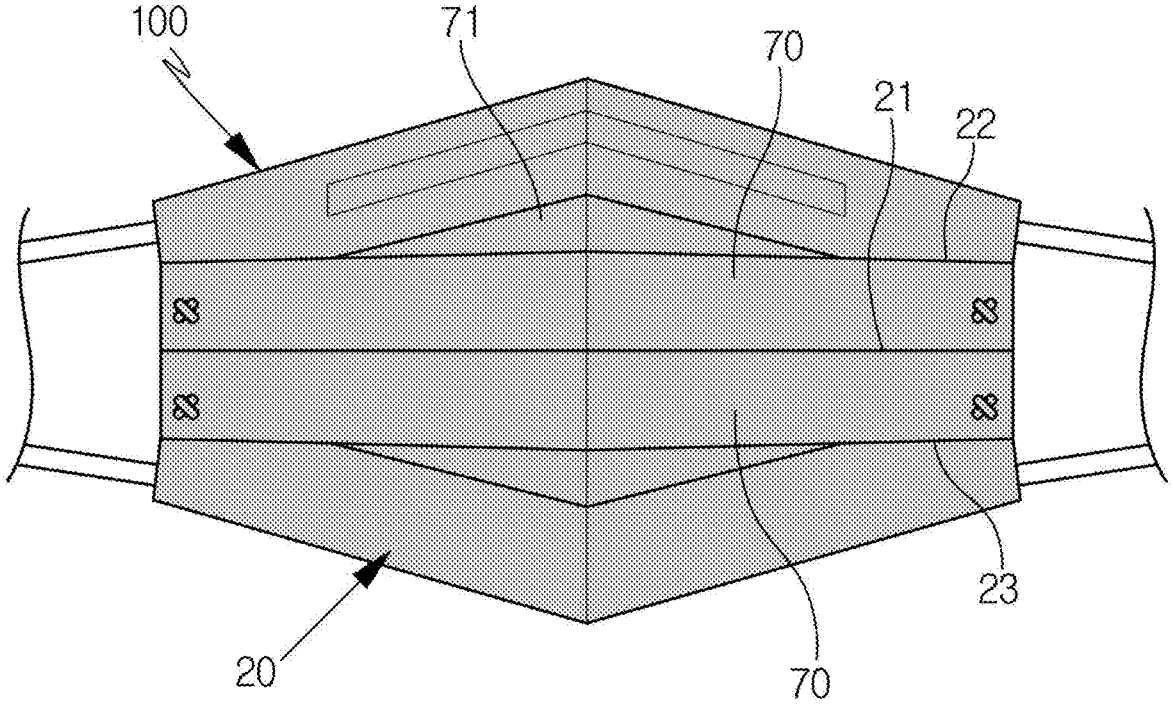
FIG. 8 is a front view illustrating a state in which the outer surface sheet of the mask having different inner and outer surface structures according to the present disclosure is exposed.

In the present disclosure constituted as described above, as illustrated in FIGS. 7 and 8, the linear-shaped portion 70 is provided on the outer surface sheet 20 forming the mask body 100 by performing the pleat portion folding process S11 and the pleat portion fusion process S12, the linear-shaped portion 70 being provided along the horizontal length direction of the outer surface sheet 20.

Figure 9:
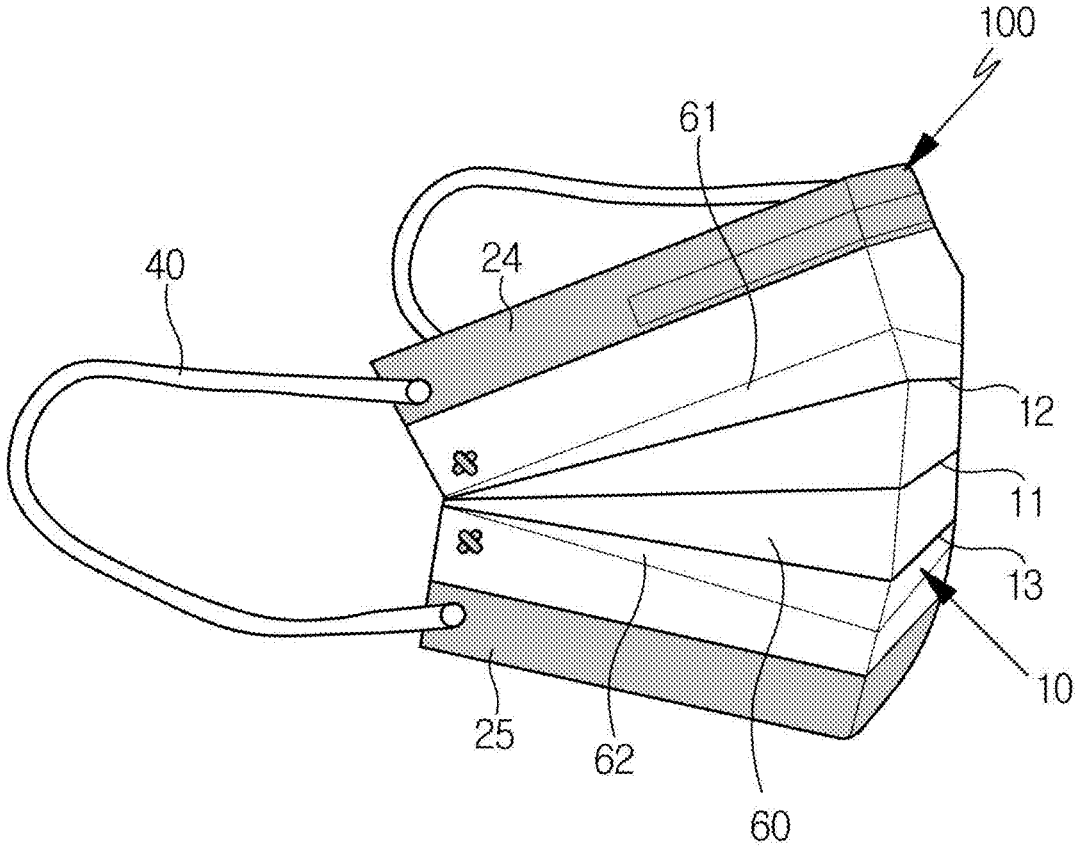
FIG. 9 is a perspective view illustrating a state in which an inner surface sheet of the mask having different inner and outer surface structures according to the present disclosure is exposed.
Figure 10:
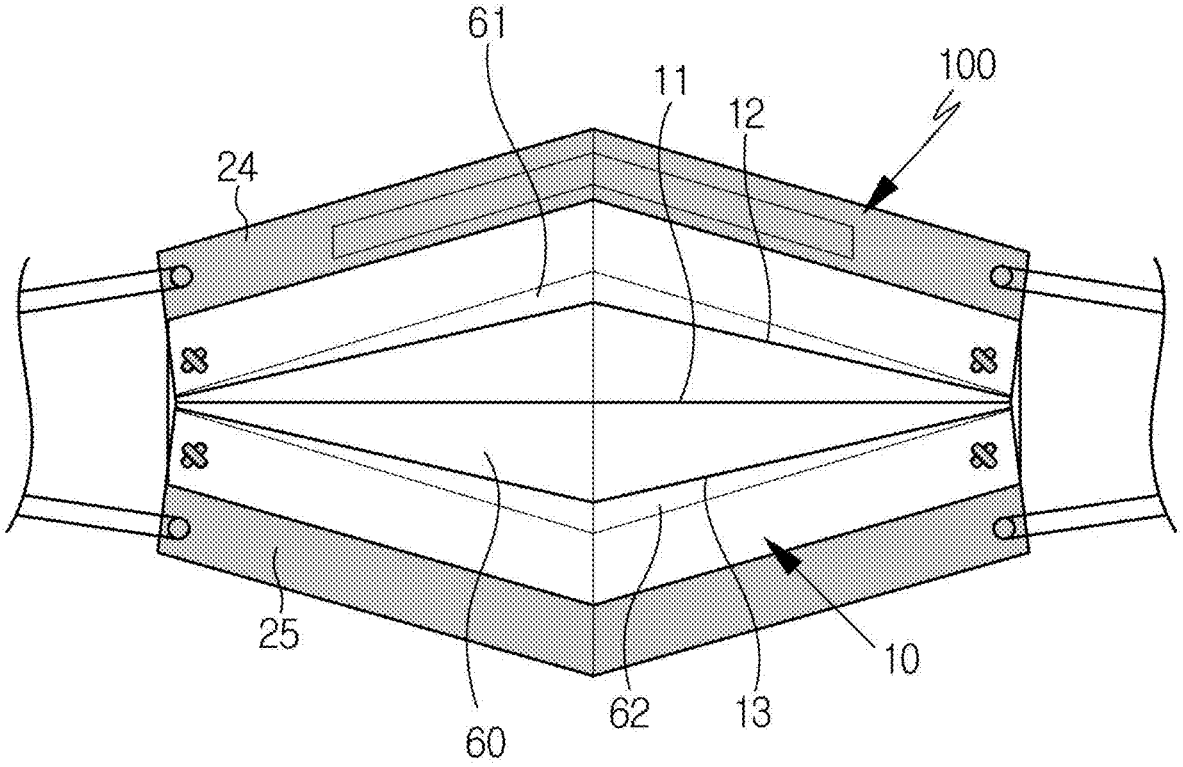
FIG. 10 is a front view illustrating a state in which the inner surface sheet of the mask having different inner and outer surface structures according to the present disclosure is exposed.

In addition, as illustrated in FIGS. 9 and 10, on the inner surface sheet 10 forming the mask body 100, the diamond-shaped portion 60 is provided along the horizontal length direction of the inner surface sheet 10.

Figure 11:
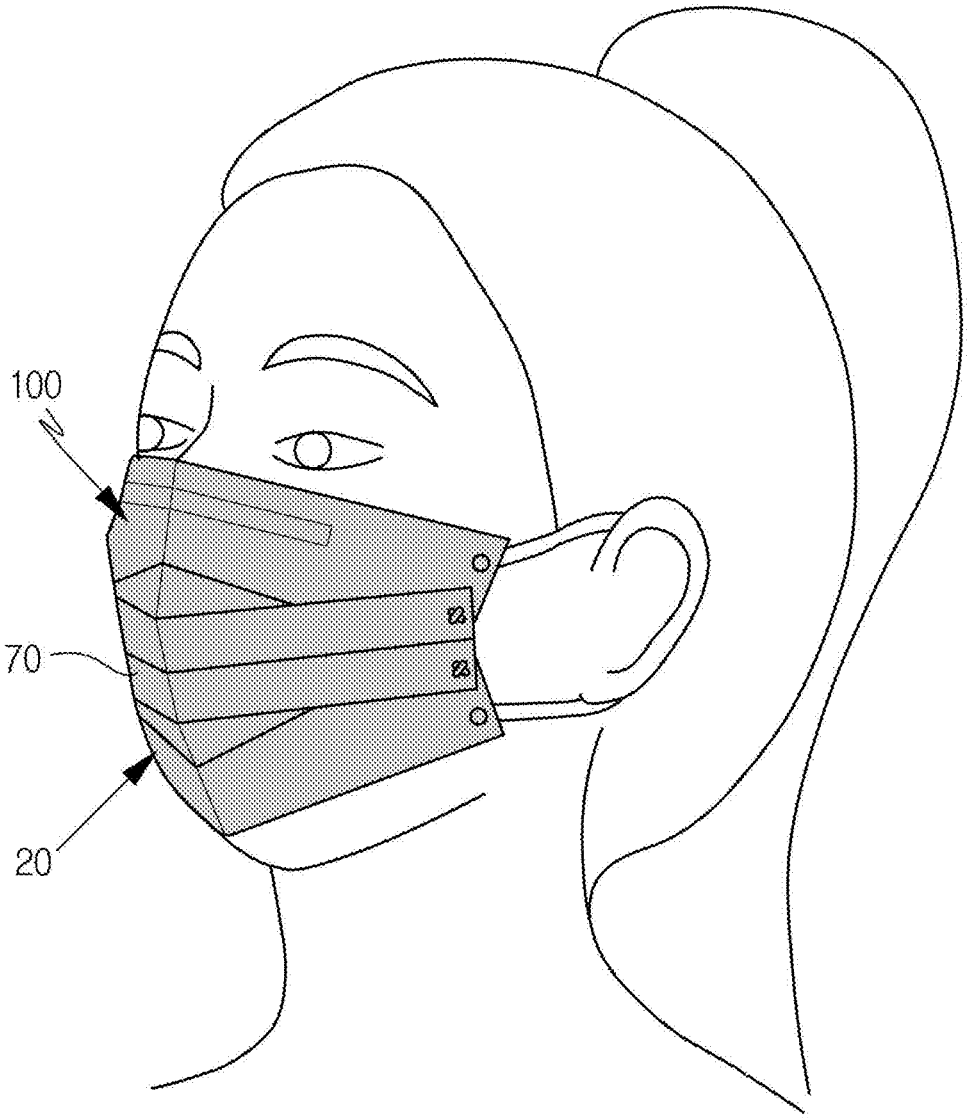
FIG. 11 is a perspective view illustrating a state of wearing the mask having different inner and outer surface structures according to the present disclosure while the outer surface sheet is exposed.

Therefore, as illustrated in FIG. 11, when a user wears the mask body 100 while the outer surface sheet 20 is exposed, the linear-shaped portion 70 is exposed to the outside, so that the appearance of the mask body 100 may be elegantly expressed by the linear-shaped portion 70 and the color of the outer surface sheet 20.

Figure 12:
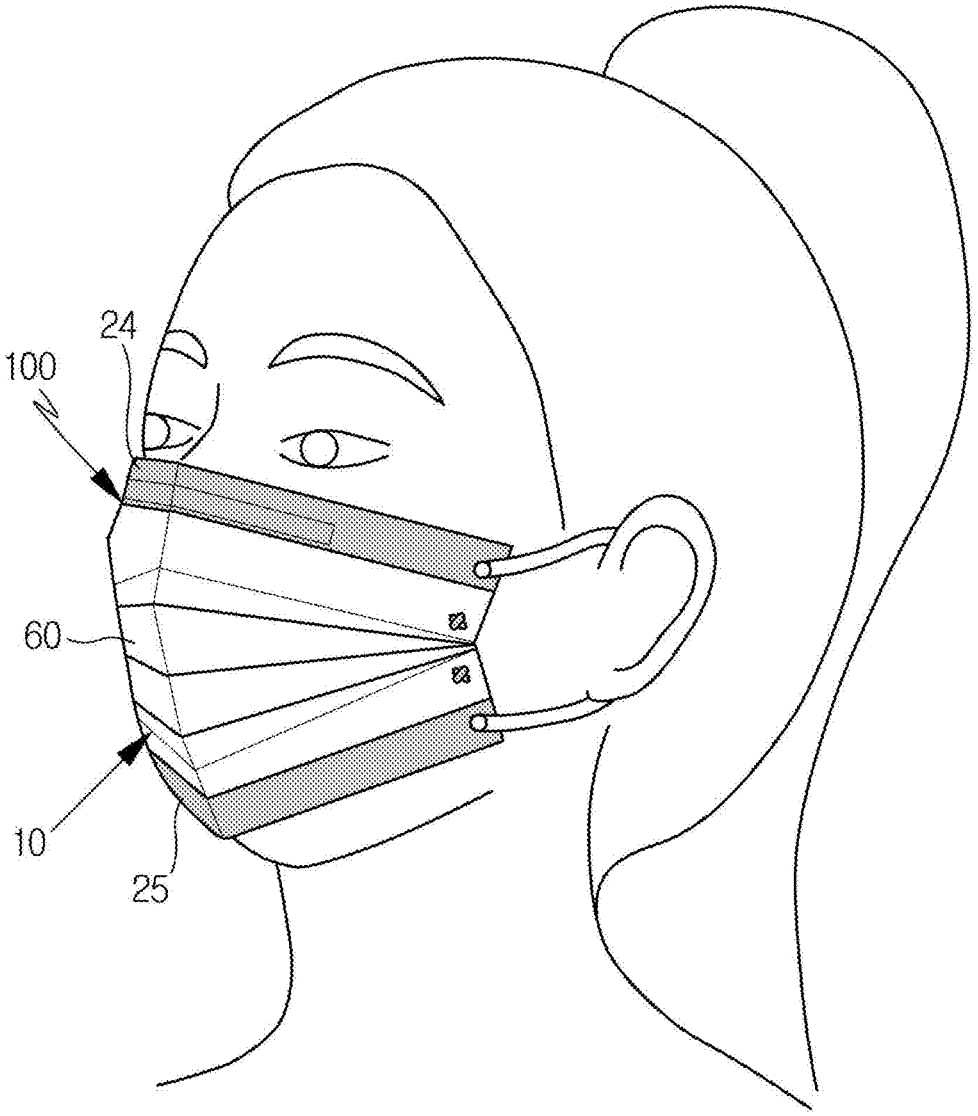
FIG. 12 is a perspective view illustrating a state of wearing the mask having different inner and outer surface structures according to the present disclosure while the inner surface sheet is exposed.

In addition, as illustrated in FIG. 12, when the user wears the mask body 100 while the inner surface sheet 10 is exposed, the diamond-shaped portion 60 is exposed to the outside, so that the appearance of the mask body 100 may be elegantly expressed by the diamond-shaped portion 60 and the color of the inner surface sheet 10.

In the method of manufacturing the mask having different inner and outer surface structures of the present disclosure, upper and lower ends of the outer surface sheet 20 are provided such that the upper and lower ends of the outer surface sheet 20 further extend with respect to upper and lower ends of the inner surface sheet 10. Furthermore, in the mask body manufacturing process S1, before the inner surface sheet 10 and the outer surface sheet 20 are overlapped, the upper and lower ends of the outer surface sheet 20 are respectively folded toward the upper and lower ends of the inner surface sheet 10 and are high-frequency fused, so that an upper covering portion 24 and a lower covering portion 25 are respectively provided at the upper end and the lower end of the inner surface sheet 10.

In the present disclosure constituted as described above, as illustrated in FIG. 12, when the user wears the mask body 100 such that the inner surface sheet 10 is exposed to the outside, the upper covering portion 24 and the lower covering portion 25 having the color of the outer surface sheet 20 are respectively exposed on the upper portion and the lower portion of the inner surface sheet 10, and the inner surface sheet 10 may generally be expressed in dual colors by the upper covering portion 24 and the lower covering portion 25, so that elegance and aesthetic sense of the mask body 100 may further be improved.

The mask having different inner and outer surface structures of the present disclosure relates to a mask which includes the mask body 100 having the upper end provided with the nose contact part 30 and which includes the ear loop strings 40 that are respectively provided at both sides of the mask body 100, and is manufactured by the method of manufacturing the mask having different inner and outer surface structures of the present disclosure.

The mask body 100 of the present disclosure includes: the inner surface sheet 10 having various colors; the outer surface sheet 20 having the color different from the color of the inner surface sheet 10; the diamond-shaped portion 60 provided on the inner surface sheet 10 along the horizontal length direction of the mask body 100; first extension portions 61 respectively provided at an upper portion and a lower portion of the diamond-shaped portion 60; the linear-shaped portion 70 provided on the outer surface sheet 20 along the horizontal length direction of the mask body 100; and second extension portions 71 respectively provided at an upper portion and a lower portion of the linear-shaped portion 70.

The first extension portions 61 is provided so that the mask body 100 is unfolded over a part of the user's face when the user wears the mask body 100 while the diamond-shaped portion 60 is exposed to the outside, and the second extension portions 71 is provided so that the mask body 100 is unfolded over the part of the user's face when the user wears the mask body 100 while the linear-shaped portion 70 is exposed to the outside.

In the present disclosure constituted as described above, when the user wears the mask body 100 by exposing the inner surface sheet 10 to the outside or by exposing the outer surface sheet 20 to the outside, two types of colors are capable of being expressed by using one mask body 100 due to the inner surface sheet 10 and the outer surface sheet 20. Therefore, for example, as the user wears the mask body 100 by selectively exposing the desired color to the outside, the color of the clothes that the user wears and the color of the mask body 100 may be well-matched with each other.

In the mask having different inner and outer surface structures of the present disclosure, as the upper portion and the lower portion of the inner surface sheet 10 are respectively covered with the upper portion and the lower portion of the outer surface sheet 20, the upper covering portion 24 and the lower covering portion 25 are respectively provided on the upper portion and the lower portion of the inner surface sheet 10.

Accordingly, since the upper portion and the lower portion of the inner surface sheet 10 may be expressed as band shapes by the upper covering portion 24 and the lower covering portion 25, the overall color of the mask body 100 may be more elegantly expressed by the upper covering portion 24 and the lower covering portion 25 having the band shapes and having the color different from the color of the inner surface sheet 10.

Although the present disclosure has been described in terms of specific items such as detailed elements as well as the limited embodiments and the drawings, they are only provided to help more general understanding of the present disclosure, and the present disclosure is not limited to the above embodiments. It will be appreciated by those skilled in the art to which the present disclosure pertains that various modifications and changes may be made from the above description.

Therefore, the spirit of the present disclosure should not be limited to the described exemplary embodiments, and all things equal or equivalent to the claims as well as the claims to be described later fall within the scope of the concept of the present disclosure.

What is claimed is:

1. A method of manufacturing a mask having different inner and outer surface structures, the method comprising:

a mask body manufacturing process in which a nose contact part is positioned at upper portions of an inner surface sheet and an outer surface sheet, the inner surface sheet and the outer surface sheet are overlapped so as to face each other, and high-frequency fusion is performed on borders of the inner surface sheet and the outer surface sheet, thereby manufacturing a mask body; and an ear loop string fusion process in which ear loop strings are high-frequency fused on both sides of the mask body, respectively, wherein the inner surface sheet and the outer surface sheet have different colors from each other, wherein in the mask body manufacturing process, center pleat portions, upper pleat portions respectively positioned at upper portions of the center pleat portions, and lower pleat portions respectively positioned at lower portions of the center pleat portions are respectively provided along a horizontal length direction of the inner surface sheet and a horizontal length direction of the outer surface sheet, and the inner surface sheet and the outer surface sheet are overlapped such that the center pleat portions, the upper pleat portions, and the lower pleat portions respectively provided at the inner surface sheet and the outer surface sheet are facing each other, and then high-frequency fusion is performed on the inner surface sheet and the outer surface sheet, thereby manufacturing the mask body, the mask body manufacturing process comprises:

a pleat portion folding process in which first side ends of the upper pleat portions and first side ends of the lower pleat portions are folded to be positioned adjacent to first side ends of the center pleat portions, respectively, and second side ends of the upper pleat portions and second side ends of the lower pleat portions are folded to be positioned adjacent to second side ends of the center pleat portions, respectively; and a pleat portion fusion process which is performed after the pleat portion folding process and in which the first side ends and the second side ends of the upper pleat portions that are folded and the first side ends and the second side ends of the lower pleat portions that are folded are high-frequency fused and fixed by pleat fusion portions, and by the pleat portion folding process and the pleat portion fusion process, a diamond-shaped portion is provided on the inner surface sheet along the horizontal length direction of the inner surface sheet, and a linear-shaped portion is provided on the outer surface sheet along the horizontal length direction of the outer surface sheet; and wherein upper and lower ends of the outer surface sheet are provided such that the upper and lower ends of the outer surface sheet further extend with respect to upper and lower ends of the inner surface sheet, in the mask body manufacturing process, before the inner surface sheet and the outer surface sheet are overlapped, the upper and lower ends of the outer surface sheet are respectively folded toward the upper and lower ends of the inner surface sheet and are high-frequency fused, so that an upper covering portion and a lower covering portion are respectively provided at the upper end and the lower end of the inner surface sheet, and the outer surface sheet is expressed in a single color, and the inner surface sheet is expressed in dual colors by the upper covering portion and the lower covering portion.

2. A mask manufactured by the method of claim 1, the mask comprising:

the mask body having an upper end provided with the nose contact part; and the ear loop strings that are respectively provided at both sides of the mask body, wherein the mask body comprises:

the inner surface sheet having various colors;

the outer surface sheet having the single color different from the colors of the inner surface sheet;

the diamond-shaped portion provided on the inner surface sheet along the horizontal length direction of the inner surface sheet;

first extension portions respectively provided at an upper portion and a lower portion of the diamond-shaped portion;

the linear-shaped portion provided on the outer surface sheet along the horizontal length direction of the outer surface sheet; and second extension portions respectively provided at an upper portion and a lower portion of the linear-shaped portion.

3. The mask of claim 2, wherein, in order for the upper portion and a lower portion of the inner surface sheet to be expressed in band shapes and to be expressed in the band shapes having a color different from the colors of the inner surface sheet, the upper covering portion and the lower covering portion having colors different from the colors of the inner surface sheet are respectively provided on the upper portion and the lower portion of the inner surface sheet as the upper portion and the lower portion of the inner surface sheet are respectively covered with the upper portion and a lower portion of the outer surface sheet.

* * * * *